United States Patent [19]

Foutsitzis et al.

[11] Patent Number: 5,035,792

[45] Date of Patent: Jul. 30, 1991

[54] CLEANUP OF HYDROCARBON-CONVERSION SYSTEM

[75] Inventors: Arthur A. Foutsitzis, Worcester, Mass.; Frank G. Padrta, Des Plaines; Michael B. Russ, Elmhurst, both of Ill.

[73] Assignee: UOP, Des Plaines, Ill.

[21] Appl. No.: 615,105

[22] Filed: Nov. 19, 1990

[51] Int. Cl.[5] ..... C10G 35/09

[52] U.S. Cl. ..... 208/138; 208/134; 134/22.1; 134/22.12; 134/22.14

[58] Field of Search ..... 208/138; 134/22.1, 27.11, 134/22.12, 27.14

[56] References Cited

U.S. PATENT DOCUMENTS

| | | | |
|---|---|---|---|
| 2,662,041 | 12/1953 | Dougherty et al. | 134/22.1 |
| 2,873,176 | 2/1959 | Hengstebeck | 23/288 |
| 3,137,646 | 6/1964 | Capsuto | 208/65 |
| 3,567,627 | 3/1971 | Feferle | 208/138 |
| 3,732,123 | 5/1973 | Stolfa et al. | 134/19 |
| 4,155,836 | 5/1979 | Collins | 208/139 |
| 4,329,220 | 5/1982 | Nelson | 208/138 |
| 4,456,527 | 6/1984 | Buss et al. | 208/89 |
| 4,507,397 | 3/1985 | Buss | 502/38 |
| 4,925,544 | 5/1990 | Robinson et al. | 208/138 |
| 4,940,532 | 7/1990 | Peer et al. | 208/138 |

*Primary Examiner*—Helane E. Myers

*Attorney, Agent, or Firm*—Thomas K. McBride; John F. Spears, Jr.; Richard E. Conser

[57] ABSTRACT

A hydrocarbon solvent is utilized to purge contaminants, such as sulfur, from a conversion system. Complementary contaminant-removal steps may include oxidation, reduction, and contaminant removal with a sacrificial particulate bed. This solvent purge avoids deactivation of a subsequently loaded contaminant-sensitive catalyst, such as a reforming catalyst selective for dehydrocyclization.

17 Claims, No Drawings

CLEANUP OF HYDROCARBON-CONVERSION SYSTEM

BACKGROUND OF THE INVENTION

1. Field of the Invention

This invention relates to an improved process for the conversion of hydrocarbons, and more specifically for the catalytic reforming of gasoline-range hydrocarbons.

2. General Background

The catalytic reforming of hydrocarbon feedstocks in the gasoline range is an important commercial process, practiced in nearly every significant petroleum refinery in the world to produce aromatic intermediates for the petrochemical industry or gasoline components with high resistance to engine knock. Demand for aromatics is growing more rapidly than the supply of feedstocks for aromatics production. Moreover, the widespread removal of lead antiknock additive from gasoline and the rising demands of high-performance internal-combustion engines are increasing the required knock resistance of the gasoline component as measured by gasoline "octane" number. The catalytic reforming unit therefore must operate more efficiently at higher severity in order to meet these increasing aromatics and gasoline-octane needs. This trend creates a need for more effective reforming catalysts for application in new and existing process units.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics and gasoline-octane needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction, thus producing a higher yield of aromatics and a lower output of fuel gas, while minimizing the formation of coke.

The effectiveness of reforming catalysts comprising a non-acidic L-zeolite and a platinum-group metal for dehydrocyclization of paraffins is well known in the art. The use of these reforming catalysts to produce aromatics from paraffinic raffinates as well as naphthas has been disclosed. The increased sensitivity to feed sulfur of these selective catalysts also is known. However, this dehydrocyclization technology has not been commercialized during the intense and lengthy development period. The extreme catalyst sulfur intolerance is believed to be the principal reason for this delay in commercialization. This catalyst may be deactivated rapidly in an existing reforming unit which previously employed a less-sulfur-sensitive catalyst for conversion of a sulfur-containing feed, since traces of sulfur contamination may remain in the process equipment even after conventional cleanup of the equipment. If the effect of sulfur contamination could be eliminated, existing reforming units could be reassigned for paraffin dehydrocyclization operations as large modern naphtha reforming units are constructed in conjunction with refinery modernizations. Conventional oxidation, reduction and acidizing do not provide the completeness of sulfur removal required. Therefore, an exceptionally effective cleanup method is needed for these existing units as a concomitant to the reforming process for paraffin dehydrocyclization.

3. Related Art

Techniques are known in the art for avoiding deactivation of reforming catalysts by sulfur oxides produced from sulfur scale on the equipment during catalyst regeneration. U.S. Pat. No. 2,873,176 (Hengstebeck) discloses avoidance of an oxidizing atmosphere in equipment, other than reactors, which has been exposed to sulfur in the feedstock in order to avoid injury to the catalyst. U.S. Pat. No. 3,137,646 (Capsuto) teaches purging of sulfur from the lead heater of a catalytic reforming unit to the heater stock until $SO_2$ is not detected to avoid deterioration of the catalyst. U.S. Pat. No. 4,507,397 (Buss) reveals that controlling the water content of a regenerating gas to no more than 0.1 mol % in a catalytic reforming unit having sulfur-contaminated vessels avoids reaction of sulfur oxides with the catalyst. The above patents relate to protecting a reforming catalyst from sulfur scale during regeneration, in contrast to the present invention which addresses the need to remove contaminants evolved during process operation.

U.S. Pat. No. 4,155,836 (Collins, et al.) discloses that sulfur-contaminated reforming catalyst may have its activity restored by discontinuing the hydrocarbon feed and passing hydrogen and halogen over the catalyst to reduce its sulfur concentration. U.S. Pat. No. 4,456,527 (Buss, et al.) teaches that a variety of sulfur-removal options may be used to reduce the sulfur content of a hydrocarbon feed to as low as 50 parts per billion for dehydrocyclization over a catalyst with high sulfur sensitivity. Buss, et al. thus recognizes the need for exceedingly low sulfur to a reforming catalyst selective for dehydrocyclization. Neither of the above references, however, contemplates the use of a hydrocarbon solvent to purge contaminants from a prior-contaminated conversion system. U.S. Pat. No. 3,732,123 (Stolfa et al.) teaches a method of descaling a heater contaminated with sulfurous and nitrogenous compounds by alternate oxidation and reduction techniques. U.S. Pat. No. 4,940,532 (Peer et al.) discloses the use and replacement of a sacrificial particulate bed to remove contaminants from a catalytic-reforming system. Peer does not contemplate the combination of purging contaminants from the equipment of a conversion system using a hydrocarbon solvent and subsequently using a contaminant-sensitive catalyst for hydrocarbon conversion, however.

SUMMARY OF THE INVENTION

It is an object of the present invention to provide a hydrocarbon-conversion process for the effective use of a contaminant-sensitive catalyst in an existing system having contaminated equipment. A more specific objective is to obtain extended catalyst life for a dehydrocyclization used in an existing catalytic reforming system.

This invention is based on the discovery that sulfur contaminants surprisingly are purged from contaminated equipment in a catalytic reforming system by contact with a hydrocarbon solvent, enabling the use of a contaminant-sensitive catalyst in the system.

A broad embodiment of the present invention is a hydrocarbon-conversion process using a hydrocarbon solvent to purge contaminants, which result from the prior processing of a contaminant-containing feed, from a conversion system followed by the loading and use of a contaminant-sensitive catalyst in the system.

In a preferred embodiment, the contaminant is sulfur. In a highly preferred embodiment, the hydrocarbon-conversion process is catalytic reforming and the equipment is freed of sulfur in order to use a sulfur-sensitive catalyst effective for the dehydrocyclization of paraffins. In an especially preferred embodiment, the hydrocarbon solvent comprises principally aromatic hydrocarbons.

These as well as other objects and embodiments will become apparent from the detailed description of the invention.

DESCRIPTION OF THE PREFERRED EMBODIMENTS

To reiterate, a broad embodiment of the present invention is a hydrocarbon-conversion process using a hydrocarbon solvent to purge contaminants, which result from the prior processing of a contaminant-containing feed, from a conversion system followed by the loading and use of a contaminant-sensitive catalyst in the system.

The conversion system of the present invention is an integrated processing unit which includes equipment, catalyst, sorbents and chemicals used in the processing of a hereinafter-defined hydrocarbon feedstock. The equipment includes reactors, reactor internals for distributing feed and containing catalyst, other vessels, heaters, heat exchangers, conduits, valves, pumps, compressors and associated components known to those of ordinary skill in the art. Preferably, the conversion system is a catalytic-reforming system.

The conversion system comprises either a fixed-bed reactor or a moving-bed reactor whereby catalyst may be continuously withdrawn and added. These alternatives are associated with catalyst-regeneration options known to those of ordinary skill in the art, such as: (1) a semiregenerative unit containing fixed-bed reactors, which maintains operating severity by increasing temperature, eventually shutting the unit down for catalyst regeneration and reactivation; (2) a swing-reactor unit, in which individual fixed-bed reactors are serially isolated by manifolding arrangements as the catalyst becomes deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, which permits higher operating severity by maintaining high catalyst activity through regeneration cycles of a few days; or, (4) a hybrid system with semiregenerative and continuous-regeneration provisions in the same unit. The preferred embodiment of the present invention is fixed-bed reactors in a semiregenerative unit.

The feed to the conversion system may contact the respective particulate bed or catalyst in the reactors in either upflow, downflow, or radial-flow mode. Since the preferred dehydrocyclization reaction is favored by relatively low pressure, the low pressure drop in a radial-flow reactor favors the radial-flow mode.

The contaminants comprise elements other than carbon or hydrogen, especially sulfur, nitrogen, oxygen or metals, which were deposited on the equipment of the conversion system in a precedent conversion process effected in the conversion system on a contaminant-containing prior feed previous to the execution of the present invention. A preferred example is sulfur introduced into the conversion system as sulfur compounds in a sulfur-containing prior feed to a precedent conversion process. As is well known, sulfur compounds decomposed in the precedent conversion operation may result in formation of metal sulfides, e.g., by reaction of hydrogen sulfide with internal surfaces of such equipment as heaters, reactors, reactor internals and conduits. Sulfur may be released from such sulfides especially in a reforming process, forming hydrogen sulfide which joins the process reactants when processing a contaminant-free feed reformer feed.

The nature of equipment contamination from the processing of a contaminant-containing prior feed which leads to the surprising results of the present invention is not well known. Sulfur contamination, for example, may result from reaction products which remain on the equipment of a catalytic-reforming system. It is believed, without limiting the invention thereby, that highly condensed, insoluble aromatic compounds can be formed while processing the prior feed by condensation of small amounts of higher-boiling, sulfur-containing, higher-boiling components of the prior feed. These insoluble compounds may not be entirely removed by the process reactants, but may instead accumulate on the equipment. When a contaminant-sensitive catalyst such as a dehydrocyclization catalyst subsequently is loaded into the catalytic-reforming system, small amounts of the highly condensed aromatic compounds may desorb from the equipment and result in catalyst deactivation. Purging of this condensed material from the system may also purge sulfur compounds, resulting in the surprising benefits of the present invention.

The amount of sulfur released during operation with a contaminant-sensitive catalyst may be minor relative to the reactants, particularly if the feed to the prior conversion process had been desulfurized or if the conversion system has been acidized or cleaned by other known chemical treatments prior to use in the process of the present invention. However, it has now been found that even minor amounts of sulfur can deactivate a catalyst selective for dehydrocyclization of paraffins, such as the sulfur-sensitive reforming catalyst described hereinafter.

In the present invention, the contaminants are purged from the conversion system by introducing a hydrocarbon solvent into the system at contaminant-purging conditions. These conditions are determined by the nature of the solvent and comprise a pressure of from about atmospheric to 100 atmospheres, preferably atmospheric to 50 atmospheres, and a temperature of from about 10° to 400° C. In a preferred embodiment, the solvent is at conditions near its critical region. The conversion system may be loaded with solvent more than once, withdrawing a load of solvent containing purged contaminants and loading contaminant-free solvent in order to purge the contaminants from the system more completely. The solvent preferably is circulated through the system such as by pumping, in order to obtain more effective contact with contaminated equipment surfaces. In an alternative embodiment, inert gases are circulated along with the solvent to improve contact between solvent and equipment. The gases are inert to reaction with the solvent or contaminant, nitrogen and hydrogen being preferred gases and nitrogen being especially preferred.

In an especially preferred embodiment, circulating solvent contacts a contaminant sorbent to remove contaminants from the solvent. Excellent results have been obtained when manganese oxide is used as a sulfur sorbent to remove sulfur from circulating solvent.

The solvent used for contaminant purging in the present invention comprises, and preferably consists essentially of, hydrocarbons. Non-hydrocarbon solvents are not recommended, and might in some cases have an adverse effect on the catalyst which subsequently is loaded into the system. A solvent comprising principally aromatic hydrocarbons has been found to be effective in the decontamination step of the present process. Catalytic reformate having an aromatics content of over 50 volume % is widely available and generally is suitable. An aromatic concentrate which may comprise toluene, $C_8$ aromatics and/or $C_9+$ aromatics is particularly effective in the present process. Solvent withdrawn from the system which contains purged contaminants may be processed in conventional refining equipment, such as by distillation, to separate the contaminants.

It is within the scope of the present invention that the process include one or more of known oxidation, reduction and acidizing steps. These steps are particularly effective in removing the sulfide scale mentioned hereinabove. Descaling as applied to heater tubes, where the problem generally is most severe, is taught in U.S. Pat. No. 3,732,123, incorporated herein by reference thereto. These known steps may be incorporated into the process before or after the solvent decontamination of the present invention, but preferably after the solvent contaminant-purging step.

It also is within the scope of the invention to contact a sacrificial feed with a sacrificial particulate bed to remove contaminants, preferably after the solvent-decontamination step. According to this alternative solvent purging removes the bulk, or most, of the contaminants and the sacrificial feed and particulate bed remove the remaining contaminants to provide a contaminant-free system. The sacrificial feed preferably is substantially contaminant-free as defined hereinafter. In the preferred catalytic-reforming system at catalytic-reforming conditions, sulfur is released from equipment surfaces at sulfur-removal conditions. By contacting the sacrificial particulate bed, sulfur released from equipment surfaces is either converted to a form more easily removable in the effluents from the conversion system, deposited on the particulate bed, or both converted and deposited on the bed. In a preferred embodiment, sulfur released from the equipment is converted to hydrogen sulfide by contact with a sacrificial reforming catalyst and the hydrogen sulfide is removed from the system by contact with a manganese oxide sorbent. The sacrificial particulate bed is removed from the conversion system when contaminant removal is substantially complete and the conversion system thus is contaminant-free. Further details of this optional step are contained in U.S. Pat. No. 4,940,532, incorporated herein by reference.

Contaminant purging is measured by testing the effluent streams from the conversion system for contaminant levels using test methods known in the art. Contaminant purging is substantially complete and the system is contaminant free when the measured level of contaminant, if contained in the hydrocarbon feed as defined hereinafter, would not cause a shut down of the conversion system due to the deactivation of the contaminant-sensitive catalyst within a three-month period of operation. Preferably the level of contaminant will be below detectable levels, by test methods known in the art, when the conversion system is contaminant-free. A preferred embodiment comprises a sulfur-free catalytic-reforming system, wherein sulfur is below detectable limits in the reactants of the catalytic-reforming system.

Each of the hydrocarbon feed and the sacrificial feed comprises paraffins and naphthenes and may comprise olefins and mono- and polycyclic aromatics. The preferred feed boils within the gasoline range and may comprise gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°–80° C. and a final boiling point of from about 150°–210° C., or it may represent a narrower range within these broad ranges. Paraffinic stocks, such as naphthas from Middle East crudes, are especially preferred hydrocarbon feeds due to the ability of the process to dehydrocyclize paraffins to aromatics. Raffinates from aromatics extraction, containing principally low-value $C_6$–$C_8$ paraffins which can be converted to valuable B-T-X aromatics, are especially preferred.

Each of the hydrocarbon feed and the sacrificial feed are substantially contaminant-free. Substantially contaminant-free is defined as a level of contaminant that, in the hydrocarbon feed, would not cause a shut down of the conversion system due to the deactivation of the contaminant-sensitive catalyst within a three-month period of operation. Preferably the level of contaminant will be below detectable levels, by test methods known in the art. Each of the first hydrocarbon feed and the hydrocarbon feed preferably has been treated by conventional methods such as hydrotreating, hydrorefining or hydrodesulfurization to convert sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB (6) and VIII (9–10) of the Periodic Table. [See Cotton and Wilkinson, *Advanced Organic Chemistry*, John Wiley & Sons (Fifth Edition, 1988)]. Alternatively or in addition to the conversion step, the feed may be contacted with sorbents capable of removing sulfurous and other contaminants. These sorbents may include but are not limited to zinc oxide, nickel-alumina, nickel-clay, iron sponge, high-surface-area sodium, high-surface-area alumina, activated carbons and molecular sieves. Best results are obtained when manganese oxide, especially a manganous oxide, is employed as a sorbent. This sulfur sorbent may be identical to the sulfur sorbent employed for contaminant removal from the solvent as described hereinbefore.

In the preferred catalytic-reforming system, sulfur-free hydrocarbon feeds have low sulfur levels disclosed in the prior art as desirable reforming feedstocks, e.g., 1 ppm to 0.1 ppm (100 ppb). Most preferably, the hydrocarbon feed contains no more than 50 ppb sulfur.

The contaminant-sensitive catalyst is loaded into the conversion system after contaminants have been purged and the system is substantially contaminant-free. The contaminant-sensitive catalyst contacts the hydrocarbon feed at hydrocarbon-conversion conditions. Hydrocarbon-conversion conditions comprise a pressure of from about atmospheric to 150 atmospheres (abs), a temperature of from about 200° to 600° C., and a liquid hourly space velocity relative to the contaminant-sensitive catalyst of from about 0.2 to 10 $hr^{-1}$. Preferably the system is a sulfur-free catalytic-reforming system and the conditions comprise reforming conditions including a pressure of from about atmospheric to 60 atmospheres (abs). More preferably the pressure is from atmospheric to 20 atmospheres (abs), and excellent results have been obtained at operating pressures of less than 10 atmospheres. The hydrogen to hydrocarbon mole ratio is from about 0.1 to 10 moles of hydrogen per mole of hydrocarbon feed. Space velocity with respect to the volume of contaminant-sensitive catalyst is from about 0.5 to 10 $hr^{-1}$. Operating temperature is from about 400° to 560° C. Since the predominant reaction of the preferred embodiment is the dehydrocyclization of paraffins to aromatics, the contaminant-sensitive catalyst will preferably be contained in two or more reactors with interheating between reactors to compensate for the endothermic heat of reaction and maintain suitable temperatures for dehydrocyclization.

The contaminant-sensitive catalyst used in hydrocarbon conversion comprises one or more metal components on a refractory support. The metal component will comprise one or more from Groups IA (1), IIA (2), IVA (4), VIA (6), VIIA (7), VIII (8-10), IIIB (13) or IVB (14) of the Periodic Table. Applicable refractory supports are as described hereinabove. The contaminant-sensitive catalyst also may contain a halogen component, phosphorus component, or sulfur component.

The contaminant-sensitive catalyst preferably is a reforming catalyst, containing a non-acidic L-zeolite and a platinum-group metal component, which is highly sulfur-sensitive. It is essential that the L-zeolite be non-acidic, as acidity in the zeolite lowers the selectivity to aromatics of the finished catalyst. In order to be "non-acidic," the zeolite has substantially all of its cationic exchange sites occupied by nonhydrogen species. More preferably the cations occupying the exchangeable cation sites will comprise one or more of the alkali metals, although other cationic species may be present. An especially preferred nonacidic L-zeolite is potassium-form L-zeolite.

It is necessary to composite the L-zeolite with a binder in order to provide a convenient form for use in the catalyst of the present invention. The art teaches that any refractory inorganic oxide binder is suitable. One or more of silica, alumina or magnesia are preferred binder materials of the sulfur-sensitive reforming catalyst. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the first reforming catalyst.

A platinum-group metal component is another essential feature of the sulfur-sensitive reforming catalyst, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.05 to 5 mass % of the catalytic composite, preferably 0.05 to 2 mass %, calculated on an elemental basis. It is within the scope of the present invention that the catalyst may contain other metal components known to modify the effect of the preferred platinum component. Such metal modifiers may include Group IVA (14) metals, other Group VIII(8-10) metals, rhenium, indium, gallium, zinc, uranium, dysprosium, thallium and mixtures thereof. Catalytically effective amounts of such metal modifiers may be incorporated into the catalyst by any means known in the art.

The final sulfur-sensitive reforming catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the sulfur-sensitive reforming catalyst are disclosed, e.g., in U.S. Pat. No. 4,619,906 (Lambert et al) and U.S. Pat. No. 4,822,762 (Ellig et al.), which are incorporated into this specification by reference thereto.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

The examples illustrate the feasibility and advantage of removing sulfur from a conversion system in the manner disclosed in the present invention.

EXAMPLE I

A process unit which had been utilized for the catalytic reforming of naphtha was cleaned to remove sulfur contamination according to prior-art techniques. The process unit comprised three reactors and associated heaters, heat exchangers, charge pump, recycle compressor, product separator, stabilizer, piping, instrumentation and other appurtenances known to the skilled routineer in catalytic-reforming art.

Heater tubes were sandjetted to remove scale. The entire process unit, except the product condenser which was bypassed, was filled with water at about 90° C. which was circulated for about 8 hours and then drained. The unit then was filled with 5% neutralized, passivated, citric acid solution. The solution was circulated for 8 hours and drained from the unit. Black sludge which was found to be draining from the bottom of each of the three reactors was washed out with water.

The unit was pressured to about 8 atmospheres with nitrogen, and the gas was circulated and gradually heated up to 455° C. Gas was circulated for about 10 hours, and the unit was cooled gradually to near-ambient temperature.

The unit was loaded with a reforming catalyst comprising platinum-in on alumina in order to determine the extent to which sulfur contamination of the equipment had been eliminated. The unit was pressured with hydrogen and temperature was raised to about 370° C. at which time feed was introduced and temperatures were raised to the 450°-500° C. range as necessary to achieve conversion. The reactants were sampled at various points within the unit, including reactor inlets, and the sulfur concentration of the reactants was determined.

EXAMPLE II

The process unit of Example I was utilized in accordance with the invention in order to determine the efficacy of the invention. The unit was inventoried with toluene having a sulfur content of 0.07 mass parts per million ("ppm"). High-point vents were opened during loading of toluene to ensure thorough contacting of surfaces with toluene.

The toluene at a temperature of 65° C. was pumped through the unit using the reactor charge pump until most of the sulfur had been removed, and closed-loop circulation of toluene then was established. After the sulfur concentration of the toluene had equilibrated throughout the system, most of the toluene was removed from the system and the unit was pressurized with nitrogen to a pressure of about 3 atmospheres. Toluene circulation with the charge pump was continued while nitrogen was recirculated with the recycle compressors of the unit. The increased velocity of circulation due to the presence of the nitrogen ensured sulfur cleanout of all of the heater passes with toluene.

When the sulfur concentration had equilibrated throughout the unit, circulation was halted and the toluene was removed from the unit then oxidized and reduced. The unit was loaded with a sulfur-sensitive reforming catalyst and the unit was pressured with hydrogen. Temperature again was raised to 370° C., naphtha feed was introduced and temperatures were raised to the 450°-500° C. range as necessary to achieve conversion.

EXAMPLE III

Sulfur levels determined in accordance with Examples I and III were compared in order to determine the efficacy of the invention. Sulfur levels are reported below for reactor inlets, as this is an indication of sulfur which would have an impact on a sulfur-sensitive catalyst loaded into each reactor. The sulfur concentration data are as follows, in mg/liter:

| | Prior Art | Invention |
|---|---|---|
| First reactor | 260 | 13 |
| Second reactor | 390 | 20 |
| Third reactor | 340 | 12 |

The lower limit of accurate sulfur detection is about 20 ppb, and the process of the invention thus provides a substantially sulfur-free system.

The cost of a loading of sulfur-sensitive reforming catalyst in a 5,000 barrel-per-day process unit according to the invention presently is about $800,000. The life of this catalyst utilized for catalytic reforming following sulfur removal from the process unit according to prior-art Example I is estimated at less than one month, in comparison to an estimated life of one year or more according to Example II. The invention thus provides substantial economic benefits.

We claim:

1. In a process for the catalytic conversion of a substantially contaminant-free hydrocarbon feed using a contaminant-sensitive catalyst, in a conversion system having equipment contaminated through contact with a contaminant-containing prior feed, the improvement comprising:

(a) introducing a hydrocarbon solvent into the conversion system, contacting substantially all of the contaminated equipment with the solvent at contaminant-purging conditions to purge the contaminants therefrom until contaminant purging from the conversion system is substantially complete and the system is contaminant-free, and withdrawing the hydrocarbon solvent containing the purged contaminants; thereafter (b) loading the contaminant-sensitive catalyst into the contaminant-free conversion system; and thereafter (c) contacting the hydrocarbon feed in the contaminant-free conversion system with the contaminant-sensitive catalyst at hydrocarbon-conversion conditions.

2. The process of claim 1 wherein step (a) comprises repeated introduction and withdrawal of the hydrocarbone solvent twice or more in sequence until the conversion system is substantially contaminant-free.

3. The process of claim 1 wherein step (a) comprises circulation of the hydrocarbon solvent within the conversion system.

4. The process of claim 3 wherein step (a) comprises circulation of an inert gas within the conversion system.

5. The process of claim 1 wherein the contaminant comprises sulfur.

6. The process of claim 1 wherein the contaminant consists essentially of sulfur.

7. In a process for the catalytic reforming of a substantially sulfur-free hydrocarbon feed, in a catalytic-reforming system using a sulfur-sensitive reforming catalyst in equipment contaminated with sulfur through contact with a prior sulfur-containing feed, the improvement comprising:

(a) introducing a hydrocarbon solvent into the catalytic-reforming system, contacting substantially all of the sulfur-contaminated equipment with the solvent at sulfur-purging conditions to purge the sulfur therefrom until sulfur purging from the catalytic-reforming system is substantially complete and the system is sulfur-free, and withdrawing the hydrocarbon solvent containing the purged sulfur; thereafter (b) loading the sulfur-sensitive catalyst into the sulfur-free catalytic-reforming system; and thereafter (c) contacting the hydrocarbon feed in the sulfur-free catalytic-reforming system at catalytic-reforming conditions with the sulfur-sensitive reforming catalyst.

8. The process of claim 7 wherein the reforming catalyst comprises a platinum-group metal component.

9. The process of claim 8 wherein the platinum-group metal comprises platinum.

10. The process of claim 7 wherein the reforming catalyst comprises a non-acidic L-zeolite.

11. The process of claim 1 wherein step (a) further comprises performing one or more each of sequential oxidations and reductions of the catalytic-reforming system.

12. The process of claim 11 wherein at least one oxidation step is performed prior to solvent sulfur-purging of the system.

13. The process of claim 1 wherein step (b) comprises contacting a sacrificial feed in the catalytic-reforming system at sulfur-removal conditions with a sacrificial particulate bed until sulfur transfer from the equipment to the particulate bed is substantially complete and the system is sulfur-free prior to loading the sulfur-sensitive catalyst into the sulfur-free catalytic-reforming system.

14. The process of claim 13 wherein the sacrificial particulate bed comprises a sulfur-resistant conversion catalyst.

15. The process of claim 13 wherein the sacrificial particulate bed comprises a sulfur sorbent.

16. The process of claim 15 wherein the sulfur sorbent comprises manganese oxide.

17. In a process for the catalytic reforming of a substantially sulfur-free hydrocarbon feed, using a sulfur-sensitive reforming catalyst in equipment contaminated with sulfur through contact with a prior sulfur-containing feed, the improvement comprising:

(a) introducing a hydrocarbon solvent into the catalytic-reforming system, contacting substantially all of the sulfur-contaminated equipment with the solvent at sulfur-purging conditions to purge the sulfur therefrom until the bulk of the sulfur has been purged from the catalytic-reforming system, withdrawing the hydrocarbon solvent containing the purged sulfur, and carrying out one or more each of sequential oxidations and reductions of the catalytic-reforming system; thereafter (b) contacting a sacrificial feed in the catalytic-reforming system at sulfur-removal conditions with a sacrificial particulate bed until sulfur transfer from the equipment to the particulate bed is substantially complete and the system is sulfur-free, and loading the sulfur-sensitive catalyst into the sulfur-free catalytic-reforming system; and thereafter (c) contacting the hydrocarbon feed in the sulfur-free catalytic-reforming system at catalytic-reforming conditions with the sulfur-sensitive reforming catalyst.

* * * * *